US011390088B2

(12) United States Patent
Osborne et al.

(10) Patent No.: US 11,390,088 B2
(45) Date of Patent: Jul. 19, 2022

(54) PRINTER FLUID PORTS

(71) Applicant: Hewlett-Packard Development Company, L.P., Spring, TX (US)

(72) Inventors: William Scott Osborne, Corvallis, OR (US); David D. Welter, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/257,034

(22) PCT Filed: Nov. 20, 2018

(86) PCT No.: PCT/US2018/061951
§ 371 (c)(1),
(2) Date: Dec. 30, 2020

(87) PCT Pub. No.: WO2020/106276
PCT Pub. Date: May 28, 2020

(65) Prior Publication Data

US 2021/0268803 A1 Sep. 2, 2021

(51) Int. Cl.
*B41J 2/175* (2006.01)
*B41F 31/02* (2006.01)

(52) U.S. Cl.
CPC ..... *B41J 2/17513* (2013.01); *B41F 31/02* (2013.01); *B41J 2202/07* (2013.01)

(58) Field of Classification Search
CPC ..... B41J 2/17513; B41J 2202/07
See application file for complete search history.

(56) References Cited

U.S. PATENT DOCUMENTS

| | | | |
|---|---|---|---|
| 5,900,896 | A | 5/1999 | Barinaga et al. |
| 5,903,293 | A | 5/1999 | Nikkeis et al. |
| 6,145,952 | A | 11/2000 | Sharma et al. |
| 6,229,114 | B1 | 5/2001 | Andrews et al. |
| 6,360,795 | B1 | 3/2002 | Bothe et al. |
| 6,364,473 | B1 | 4/2002 | Liu |
| 6,969,161 | B2 | 11/2005 | Kuwabara et al. |
| 7,607,770 | B2 | 10/2009 | Inoue et al. |
| 2004/0085407 | A1 | 5/2004 | Cox et al. |
| 2007/0035596 | A1 | 2/2007 | Gray et al. |

(Continued)

FOREIGN PATENT DOCUMENTS

| | | | |
|---|---|---|---|
| CN | 1747838 | A | 3/2006 |
| CN | 101028763 | A | 9/2007 |

(Continued)

*Primary Examiner* — Justin Seo
(74) *Attorney, Agent, or Firm* — HP Inc. Patent Department

(57) ABSTRACT

An example fluid handling system for a printer is disclosed. In an implementation, the fluid handling system includes a first compartment, a second compartment, and a fluid port. The first compartment is fluidly coupled to the second compartment through the fluid port and the first compartment, second compartment and fluid port are disposable within a printer. In addition, the fluid handling system includes a barrier disposed within the fluid port. The barrier separates the fluid port into a first channel and a second channel, wherein the barrier is movable within the fluid port.

13 Claims, 9 Drawing Sheets

(56) References Cited

U.S. PATENT DOCUMENTS

| | | | | |
|---|---|---|---|---|
| 2007/0171263 | A1* | 7/2007 | Inoue | B41J 2/17509 347/74 |
| 2010/0103232 | A1 | 4/2010 | Fukushima | |
| 2014/0083564 | A1 | 3/2014 | Yan | |

FOREIGN PATENT DOCUMENTS

| | | | |
|---|---|---|---|
| CN | 101186151 | A | 5/2008 |
| CN | 101310987 | A | 11/2008 |
| CN | 103363168 | A | 10/2013 |
| JP | H09207352 | A | 8/1997 |
| WO | WO-2009017676 | A1 | 2/2009 |
| WO | 2018/094044 | A1 | 5/2018 |

* cited by examiner

PRINTER FLUID PORTS

BACKGROUND

Printers may employ a liquid printing agent to produce an image on a substrate (e.g., a piece of paper). To facilitate the use of such a liquid printing agent, printers may include multiple internal compartments and fluid paths for flowing or transporting the liquid printing agent (e.g., ink) throughout the printer and ultimately to the substrate.

BRIEF DESCRIPTION OF THE DRAWINGS

Various examples will be described below referring to the following figures.

DETAILED DESCRIPTION

Figure 1:
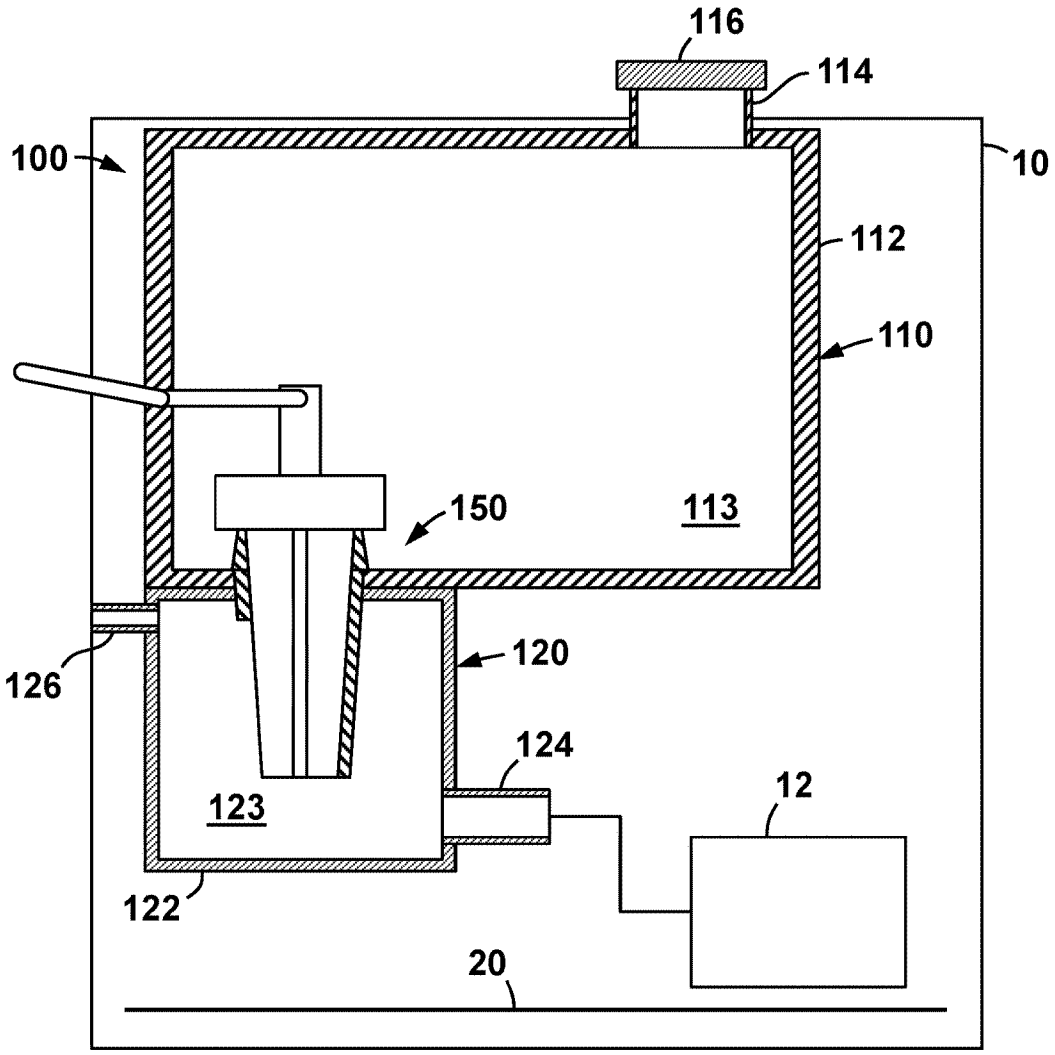
FIG. 1 is a schematic, partial cross-sectional view of a printer including a fluid handling system according to some examples.

The following discussion is directed to various examples. However, one of ordinary skill in the art will understand that the examples disclosed herein have broad application, and that the discussion of any example is meant to be descriptive of that example, and not intended to suggest that the scope of the disclosure, including the claims, is limited to that example.

The drawing figures are not necessarily to scale. Certain features and components herein may be shown exaggerated in scale or in somewhat schematic form and the details of some elements may not be shown in interest of clarity and conciseness.

In the following discussion, and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. As used herein, the terms "about," "approximately," "substantially," and the like mean plus or minus 20% of the stated value or direction. As used herein, the term "computing device" refers to any device (or collection of devices) that are to execute, store, and/or deliver machine readable instructions (such as, for example, software). Thus, the term "computing device" may include, for example, desktop computers, laptop computers, tablet computers, servers, smart phones, smart watches, personal data assistants, etc.

In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As previously described, printers may include multiple internal compartments and fluid paths for flowing or transporting a liquid printing agent (e.g., ink) throughout the printer and ultimately to the substrate (e.g., pieces of paper, a roll of paper, etc.). As the liquid printing agent flows through the compartments and fluid paths within the printer, air or other gases typically flow or migrate counter to the advancing printing agent in order to equalize the pressures within the printer. However, the counter migrating gases (e.g., air) can encounter resistance within the internal fluid paths such that so-called "gas-lock" or "air-lock" can occur, whereby a bubble (or multiple bubbles or a meniscus) of gas blocks the fluid flow path such that the flow of printing agent is stopped (or restricted). Accordingly, the examples disclosed herein provide for gas-liquid exchange fluid ports that allow the counter flow or movement of a liquid printing agent and gases (e.g., air). Thus, through use of the fluid ports described herein, the flow reliability of printing agent throughout a printer is enhanced. In the following description, counter-flowing gases (e.g., gases that flow counter to the liquid printing agent) within a printer are generically referred to as "air"; however, it should be appreciated that any gas may be disposed within the disclosed printers and fluid handling systems. Therefore, use of the term "air" in the following description should not be interpreted as limiting the other potential gases that may exist and flow within the disclosed printers and fluid handling systems during operations.

Referring now to FIG. 1, a printer 10 including a fluid handling system 100 and a printing mechanism 12 according to some examples is shown. During operations, printer 10 places a printing agent onto a substrate 20 via the printing mechanism 12 (e.g., according to machine readable instructions transmitted from a separate computing device) to form an image on the substrate 20. In some examples, the printing agent is a liquid printing agent, such as, for example, liquid ink. Thus, in some examples, printer 10 may be an inkjet printer. In addition, in this example, substrate 20 is a piece of paper; however, in other examples substrate 20 may be a paper fed from a roll, or may be some other surface or object capable of receiving a printing agent thereon. Further, printing mechanism 12 may comprise any suitable mechanism or assembly for disposing printing agent onto substrate 20 (e.g., a print head, roller or combination thereof). During printing operations, printing mechanism 12 receives printing agent from fluid handling system 100 and deposits the printing agent onto the substrate 20. Thus, fluid handling system 100 may operate to store and transport the liquid printing agent as desired within printer 10.

Fluid handling system 100 includes a first compartment 110 and a second compartment 120 fluidly coupled to one another through a fluid port 150. During operations, printing agent (not shown) is flowed or provided from first compartment 110 to second compartment 120 through fluid port 150, and then from second compartment 120 to printing mechanism 12. In this example, first compartment 110 is disposed vertically above second compartment 120, and thus, printing agent flows from first compartment 110 to second compartment 120, via fluid port 150, under the force of gravity. It should be appreciated that other components, fluid compartments, and/or flow passages may be disposed upstream and downstream of fluid handling system 100 within printer 10, such as between fluid handling system 100 and printing mechanism 12.

Figure 2:
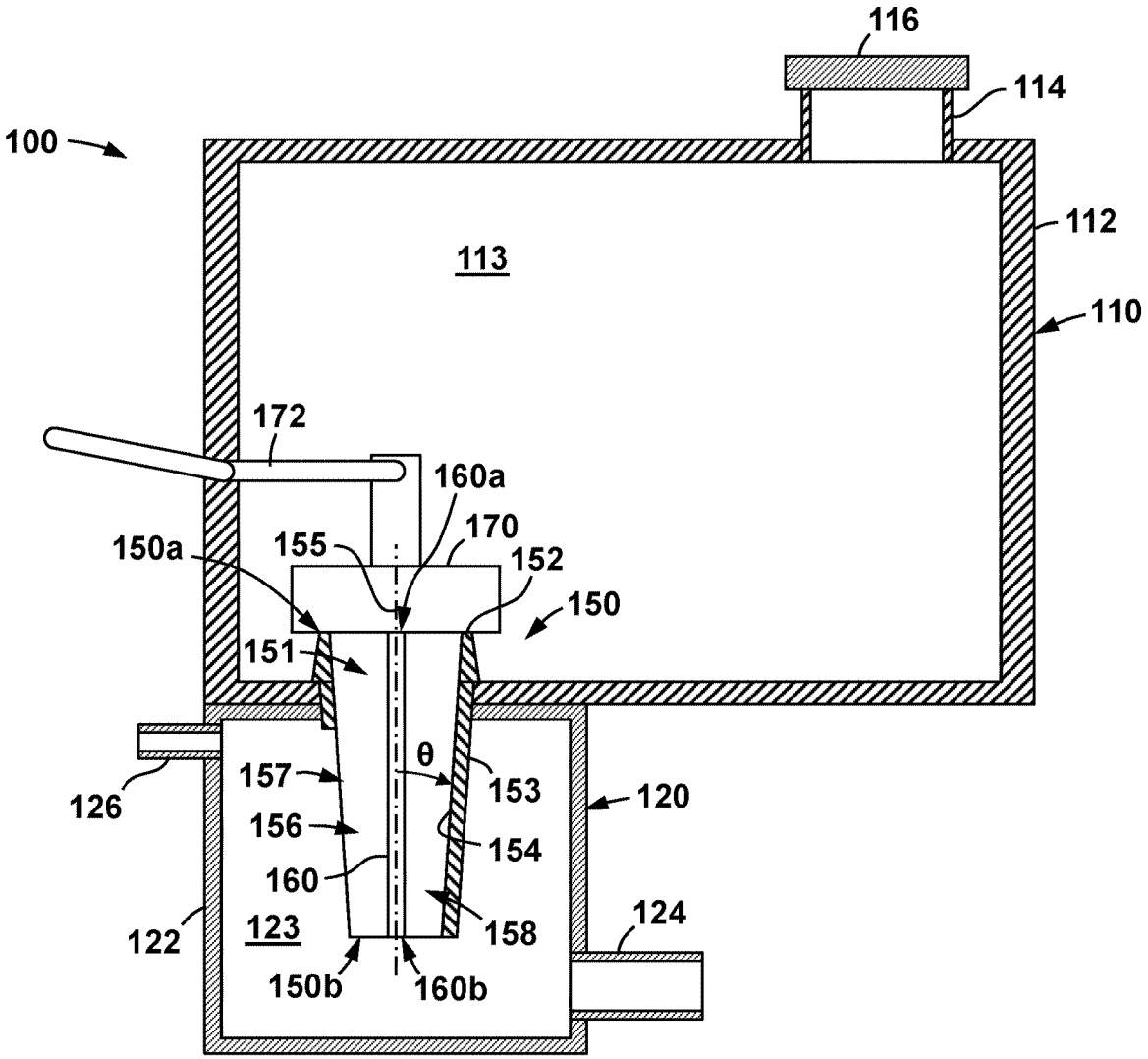
FIG. 2 is a schematic, partial cross-sectional view of the fluid handling system of FIG. 1.

Referring now to FIG. 2, first compartment 110 includes a wall or housing 112 that defines an inner chamber 113. A filling port 114 extends into chamber 113 at a vertically upper side of compartment 110. Port 114 includes a lid or cap 116 that is placed over port 114 to selectively close chamber 113. In this example, cap 116 sealingly engages with port 114 so that fluids (e.g., air, printing agent, etc.) are prevented from entering and exiting chamber 113 within first compartment 110 via port 114 when cap 116 is closed. In some examples, printing agent is filled into first compartment 110 via port 114, and thus, in these examples, port 114 is externally accessible from printer 10 (i.e., port 114 extends outside the outer housing of printer 10 or is accessible via an access door or cover on an outer housing of printer 10).

Second compartment 120 includes a wall or housing 122 that defines an inner chamber 123. An exit port 124 extends into chamber 123 at a position proximate (or on) the vertically lower side of second compartment 120. Exit port 124 is fluidly coupled (e.g., either directly or indirectly) to printing mechanism 12, such that during a printing operation, printing agent is flowed or provided from second compartment 120 to printing mechanism 12 via exit port 124. In addition, second compartment 120 also includes a vent port 126 extending into chamber 123. In this example, vent port 126 is disposed at a position proximate (or on) a vertically upper end of second compartment 120; however, in other examples vent port 126 may be disposed equidistant between the vertically upper and lower ends of second compartment 120 or may be more proximate vertically lower end of compartment 120. Vent port 126 is in fluid communication with the environment outside of printer 10 (e.g., the atmosphere), and therefore, the pressure of second compartment 120 is maintained at the pressure of the environment surrounding printer 10 (e.g., atmospheric pressure).

While both the first compartment 110 and second compartment 120 are shown to be vertically above (or partially above) printing mechanism 12, it should be appreciated that the relative placement of fluid handling system 100 and printing mechanism 12 (specifically compartments 110, 120) may be greatly varied in other examples. For instance, one of the compartments 110, 120, or both of the compartments 110, 120 may be placed vertically above, below, or even with printing mechanism 12. Thus, the depicted arrangement of fluid handling system 100 relative to printing mechanism 12 (and substrate 20) in FIG. 1 is merely schematic and is not meant to limit the relative positions of fluid handling system 100, printing mechanism 12, and substrate 20.

Referring still to FIG. 2, fluid port 150 extends between the first compartment 110 and the second compartment 120, and thus places chambers 113, 123 in fluid communication with one another. Fluid port 150 includes central axis 155, a first or upper end 150*a*, and a second or lower end 150*b* opposite upper end 150*a*. As previously described in this example, first compartment 110 is disposed vertically above second compartment 120. Thus, fluid port 150 and axis 155 extend substantially vertically through a lower side of first compartment 110 and an upper side of second compartment 120 (i.e., axis 155 extends substantially vertically). However, it should be appreciated that fluid port 150 (particularly axis 155) may not extend substantially vertically in other examples. Regardless, in the example of FIG. 2, upper end 150*a* of port 150 is disposed within chamber 113 of first compartment 110 while lower end 150*b* of fluid port 150 is disposed within chamber 123 of second compartment 120.

Figure 3:
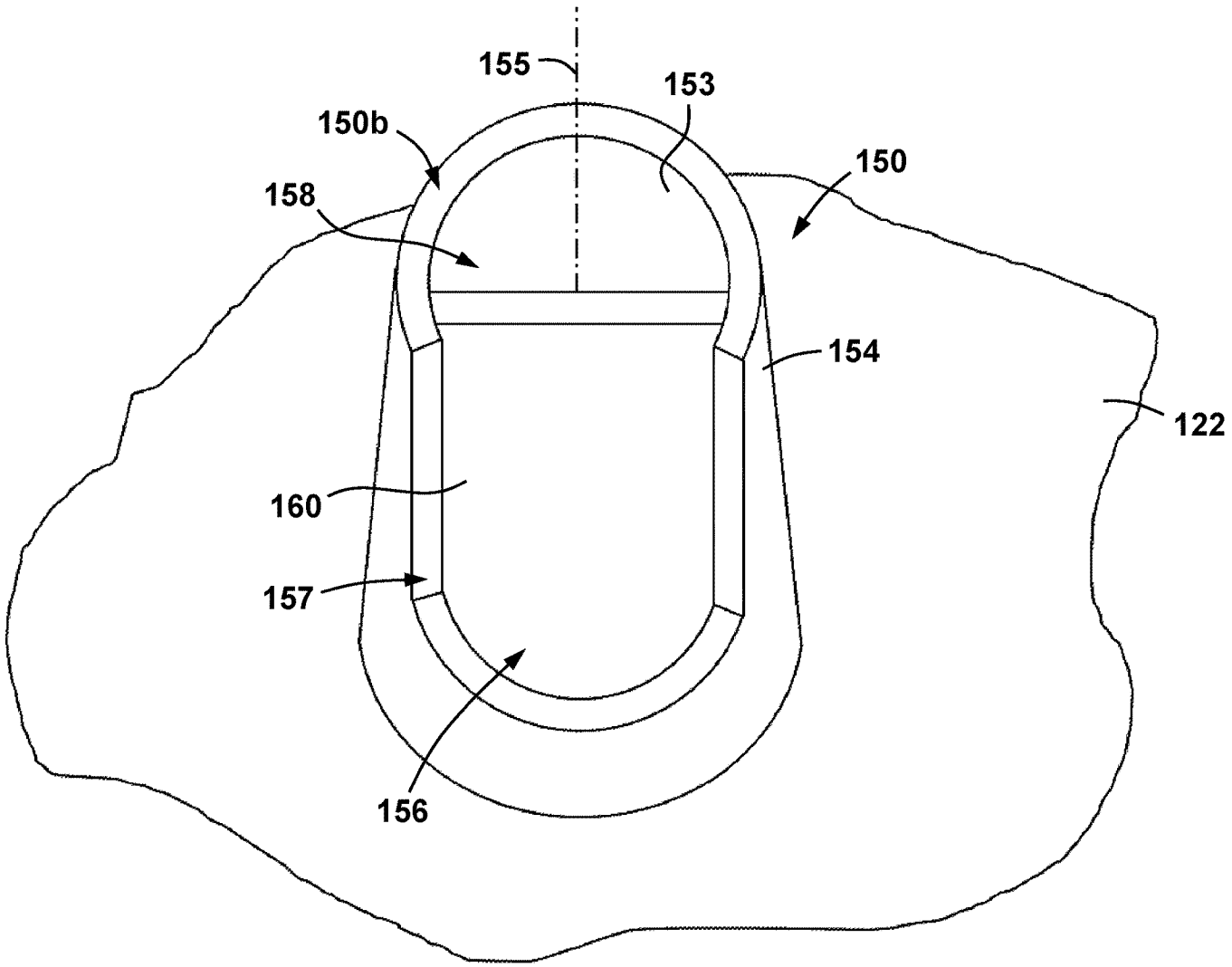
FIG. 3 is a perspective view of a portion of the fluid port of the fluid handling system of FIG. 1.

Referring now to FIGS. 2 and 3, fluid port 150 includes a radially inner surface 154 extending between ends 150*a*, 150*b*, and a radially outer surface 153 also extending between ends 150*a*, 150*b*. Radially inner surface 154 may be referred to herein as inner wall 154 and radially outer surface 153 may be referred to herein as outer wall 153. Inner wall 154 defines an internal passage or throughbore 151 extending between ends 150*a*, 150*b*. Ends 150*a*, 150*b* are both open, thereby allowing fluid communication between throughbore 151 and chambers 113, 123, via ends 150*a*, 150*b*, respectively.

A recess 157 extends axially from lower end 150*b* of fluid port 150 that also extends radially between inner wall 154 and outer wall 153 (recess 157 is best shown in FIG. 3). Accordingly, recess 157 represents an arcuate hole or aperture that is in fluid port 150 within chamber 123 of second compartment 120, and throughbore 151 is in fluid communication with chamber 123 of second compartment 120 via lower end 150*b* and recess 157 (see FIGS. 2 and 3).

As best shown in FIG. 2, in this example, both inner wall 154 and outer wall 153 taper radially outward or away from central axis 155 when moving from lower end 150*b* to upper end 150*a* (i.e., when moving from second compartment 120 to first compartment 110). In this example, both inner wall 154 and outer wall 153 are tapered relative to central axis 155 at an angle θ, that may be a positive angle (i.e., greater than 0°). In some examples, the angle θ is greater than or equal to about 1°, and in other examples, the angle θ ranges from about 1° to about 10°. In some examples, the angle θ equals approximately 2°. In some examples, inner wall 154 is tapered along angle θ, while outer wall 153 extends substantially axially between ends 150*a*, 150*b*. In still other examples, inner wall 154 and outer wall 153 are tapered at different angles.

Referring still to FIGS. 2 and 3, a barrier 160 is disposed within throughbore 151 of fluid port 150. In this example, barrier 160 extends axially within throughbore 151 to thereby separate throughbore 151 into a first channel 156 and a second channel 158. Channels 156, 158 each extend axially between open ends 150*a*, 150*b* of fluid port 150, and thus define independent flow paths for fluids (e.g., printing agent, air, etc.) through port 150 between chambers 113, 123 of compartments 110, 120, respectively. Open upper end 150*a* of fluid port 150 defines an entrance (which may be an inlet or outlet depending on the direction of fluid flow) into each channel 156, 158 within chamber 113 of first compartment 110. Lower end 150*b* of fluid port 150 defines another entrance into channel 158 (which again may be an inlet or an outlet depending on the direction of fluid flow) within chamber 123 of second compartment 120. Further, both lower end 150*b* of fluid port 150 and recess 157 define an entrance into channel 156 within chamber 123 of second compartment 120 (which may be an inlet or outlet depending on the direction of fluid flow).

Figure 5:
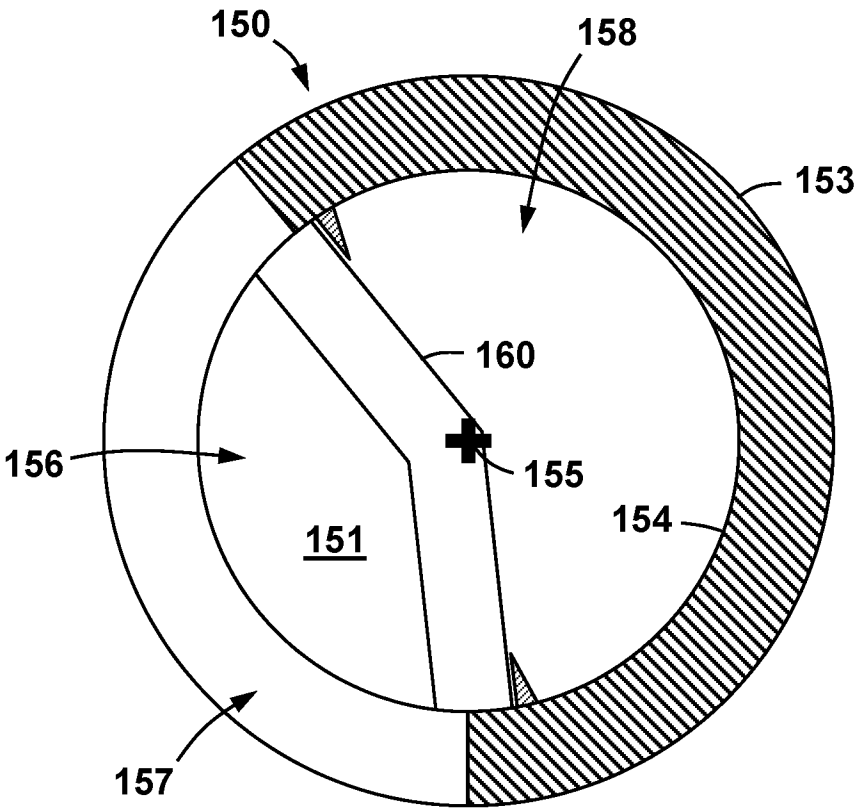
FIG. 5 is a cross-sectional view of another fluid port for use within the fluid handling system of FIG. 1 according to some examples.
Figure 4:
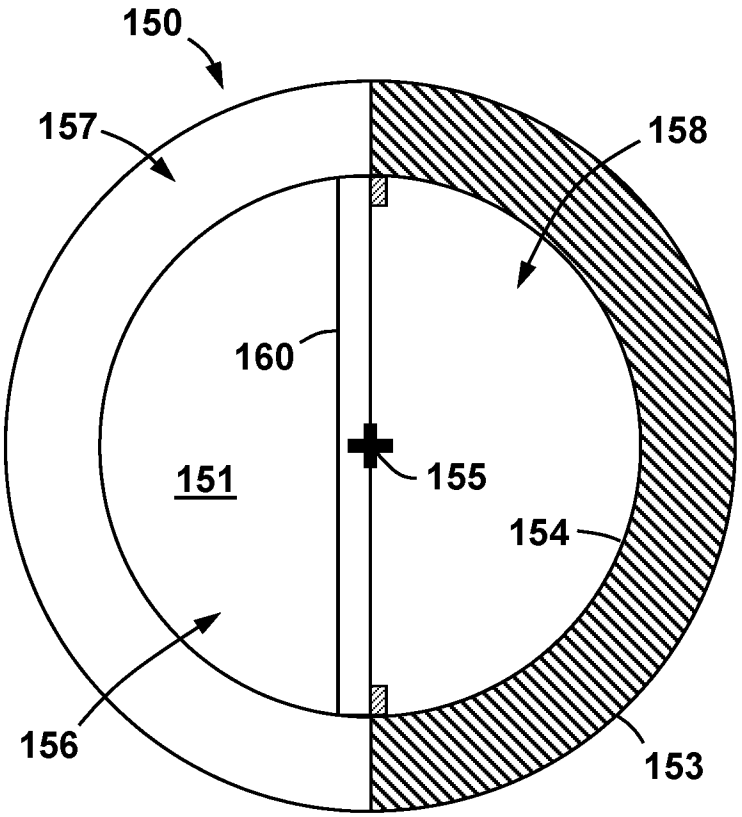
FIG. 4 is a cross-sectional view of the fluid port of the fluid handling system of FIG. 1.

Referring now to FIGS. 4 and 5, barrier 160 may comprise a number of different forms or shapes within fluid port 150 in various examples. Referring specifically to FIG. 4, in this example, barrier 160 is rectangular in cross-section and extends substantially radially across throughbore 151. In other examples, the shape of barrier 160 may be different than that shown in FIG. 4. For example, referring to FIG. 5, in some examples barrier 160 may have a chevron-type cross-section. In still other examples, barrier 160 may have a curved cross-section. Without being limited to this or any other theory, the shape of barrier 160 affects the relative cross-sectional division of throughbore 151 between channels 156, 158. Thus, the size, shape, cross-section, etc., of barrier 160 may be altered to provide the desired division of this cross-sectional area between channels 156, 158. In addition, the materials making up barrier 160 as well as the rest of fluid port 150 (and even compartments 110, 120) may be selected (in combination with the other physical parameters discussed above) to achieve a maximum flow rate (e.g., through port 150) and/or reliability during operations.

Referring back again to FIG. 2, barrier 160 has a first or upper end 160*a*, and a second or lower end 160*b* opposite upper end 160*a*. Upper end 160*a* is coupled to a valve member 170 that may selectively, sealingly engage with a valve seat 152 defined at upper end 150*a* of fluid port 150. Valve member 170 is coupled to a lever assembly 172. As will be described in more detail below, valve member 170 is movable within chamber 113 of first compartment 110 by actuation or manipulation of lever assembly 172. Thus, actuation of valve member 170 via lever assembly 172 provides for selective fluid communication between chambers 113, 123 of compartments 110, 120, respectively, via channels 156, 158 of fluid port 150 during operations. In addition, as will also be described in more detail below, actuation of valve member 170 within chamber 113 also causes axial actuation of barrier 160 within throughbore 151.

Figure 7:
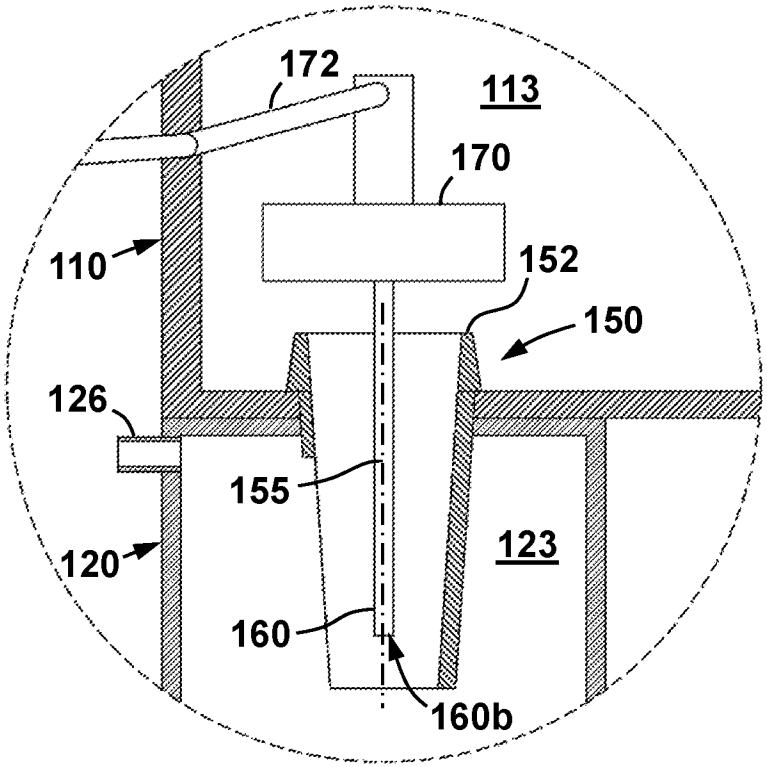
FIGS. 6 and 7 are progressive enlarged, partial cross-sectional views of the fluid port of the fluid handling system of FIG. 1 showing the valve member and barrier of the fluid port transitioning between an open and closed position.
Figure 6:
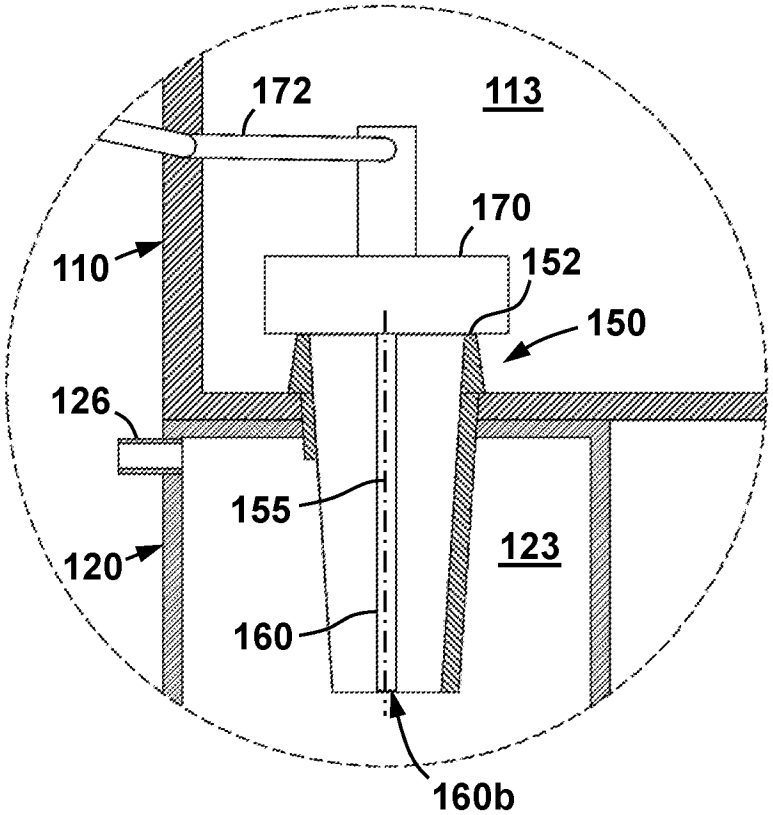

Referring now to FIGS. 6 and 7, in this example, barrier 160 and valve member 170 are axially transitionable or actuatable via actuation or manipulation of lever assembly 172 between a first position shown in FIG. 6 and a second position shown in FIG. 7. In the first position of FIG. 6, valve member 170 is engaged (e.g., sealingly engaged) with valve seat 152, and lower end 160*b* of barrier 160 is disposed within throughbore 151 proximate to or aligned with lower end 150*b* of fluid port 150. In the second position of FIG. 7, valve member 170 is disengaged from and axially separated from valve seat 152 and barrier 160 is axially shifted or translated upward from the first position (see FIG. 6). Thus, lower end 160*b* of barrier 160 is more proximate lower end 150*b* of fluid port 150 when barrier 160 is in the first position of FIG. 6 than when barrier 160 is in the second position of FIG. 7.

As previously described, when valve member 170 and barrier 160 are in the first position (FIG. 6), valve member 170 may be sealingly engaged with valve seat 152, and when valve member 170 and barrier 160 are in the second position (FIG. 7), valve member 170 is axially spaced from valve seat 152. Accordingly, when valve member 170 and barrier 160 are in the first position of FIG. 6, fluid communication is prevented (or restricted) from flowing between throughbore 151 (and thus channels 156, 158) and chamber 113 via upper end 150*a* of fluid port 150, and when valve member 170 and barrier 160 are in the second position of FIG. 7, fluid communication is established between throughbore 151 (and thus channels 156, 158) and chamber 113 via upper end 150*a* of fluid port 150. Thus, the first position of FIG. 6 may be referred to herein as a "closed" position, and the second position of FIG. 7 may be referred to herein as an "open" position.

Lever assembly 172 may be actuated via any suitable method to transition valve member 170 and barrier 160 between the open and closed positions of FIGS. 7 and 6, respectively. For instance, in some implementations, lever assembly 172 may be actuated directly by a user engaging with a distal end of lever assembly 172 that extends outside of an outer housing of printer 10 (see e.g., FIG. 1). In other implementations, the actuation of lever assembly 172, and thus valve member 170 and barrier 160 is tied or coupled (e.g., mechanically, electrically) to the opening and closing of cap 116 on port 114. In these implementations, a user may open cap 116 to refill first compartment 110, and the opening of cap 116 may cause (e.g., again via mechanical linkage and/or electrical actuation) lever assembly 172 to actuate valve member 170 and barrier 160 to the closed position of FIG. 6, thereby preventing the flow of printing agent from the first compartment 110 to the second compartment 120. Conversely, in these examples when the cap 116 is again closed (e.g., such as at the completion of filing chamber 113 of first compartment 110), the lever assembly 172 is actuated (via the mechanical linkage or electronic actuation previously described above) to transition valve member 170 and barrier 160 to the open position of FIG. 7 and once again establish fluid communication between compartments 110, 120 via fluid port 150.

Figure 8:
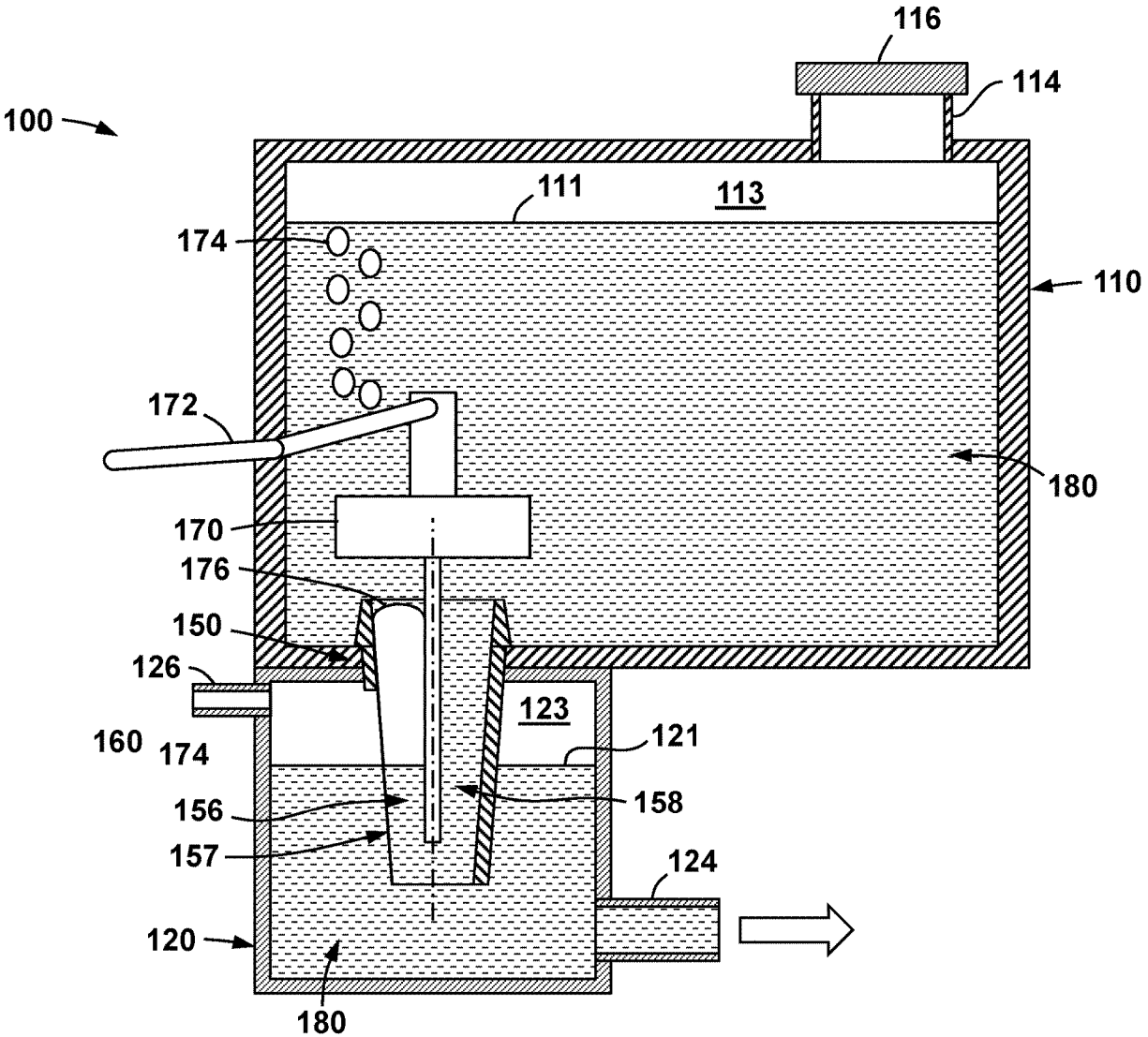
FIG. 8 is a schematic, partial cross-sectional view of the fluid handling system of FIG. 1 showing liquid printing agent flowing therethrough.

Referring now to FIGS. 2 and 8, during operations, liquid printing agent 180 is placed within chamber 113 of first compartment 110 via filling port 114. Thereafter, cap 116 is closed and valve member 170 and barrier 160 are actuated via lever assembly 172 to the open position (see e.g., FIG. 7), such that the printing agent 180 begins to flow from chamber 113, through channels 156, 158 of fluid port 150, and into chamber 123 of second compartment 120. As a result, the liquid level 121 of printing agent 180 within chamber 123 of second compartment 120 begins to rise and air 174 that is present within chamber 123 (e.g., air that is communicated into chamber 123 via vent port 126) is allowed to flow or bubble through channel 156, via recess 157 and into chamber 113 of first compartment 110. The air 174 entering chamber 113 from channel 156 collects at the upper end of chamber 113, thereby displacing printing agent 180 as it is drained into chamber 123 of second compartment 120.

Because cap 116 is closed, and fluids are therefore prevented from entering chamber 113 via port 114, the flow of printing agent 180 out of chamber 113 via port 150 reduces the air pressure within chamber 113 relative to the air pressure within chamber 123 (which is in communication with the outer environment or atmosphere via port 126 as previously described above). However, without being limited to this or any other theory, because the entrance (or exit) into channel 156 is vertically higher than the entrance (or exit) into channel 158 within chamber 123, a difference in head pressure for the liquid printing agent 180 is formed within port 150 between channels 156, 158 that encourages the flow of printing agent 180 into chamber 123 via channel 158, and the counter flow of air into chamber 113 via channel 156. Thus, fluid port 150 serves as an air-liquid exchange port between the chambers 113, 123 that vents air displaced from second compartment 120 by the liquid printing agent 180 entering chamber 123 via fluid port 150 (specifically channel 158), thereby ensuring a reliable flow of liquid printing agent 180 between chambers 113, 123 during operations. Accordingly, first channel 156 may be referred to herein as an air channel and second channel 158 may be referred to herein as a liquid channel.

In some examples, the fluid flow rates between chambers 113, 123 may be relatively slow. As a result, rather than a continuous stream of bubbles 174 emitting from channel 156, a meniscus 176 may form within channel 156 proximate upper end 150*a* of port 150. Accordingly, as printing agent 180 slowly flows (e.g., seeps) through channel 158 into chamber 123, the meniscus 176 periodically erupts or bursts into a group of air bubbles 174 that migrate upward within chamber 113.

While air 174 is typically encouraged to flow through channel 156 into chamber 113 of first compartment 110 due to, for example, the relatively larger (and vertically higher) opening or inlet into channel 156 provided by recess 157 as previously described, it should be appreciated that liquid printing agent 180 and air 174 may periodically flow through either channel 156, 158 during operations, based on a variety of factors. Specifically, in some examples, air 174 may also migrate or flow into chamber 113 through liquid channel 158 and printing agent 180 may flow into chamber 123 through air channel 156 during operations.

Referring still to FIGS. 2 and 8, the flow of printing agent 180 between chambers 113, 123 via fluid port 150 may continue until liquid level 121 within chamber 123 reaches an upper limit. For example, in some implementations, the upper limit for liquid level 121 may be located at the upper end of recess 157.

However, the design of fluid handling system 100 may be altered in other examples to change the location of the upper limit of liquid level 121 within chamber 123.

Figure 9:
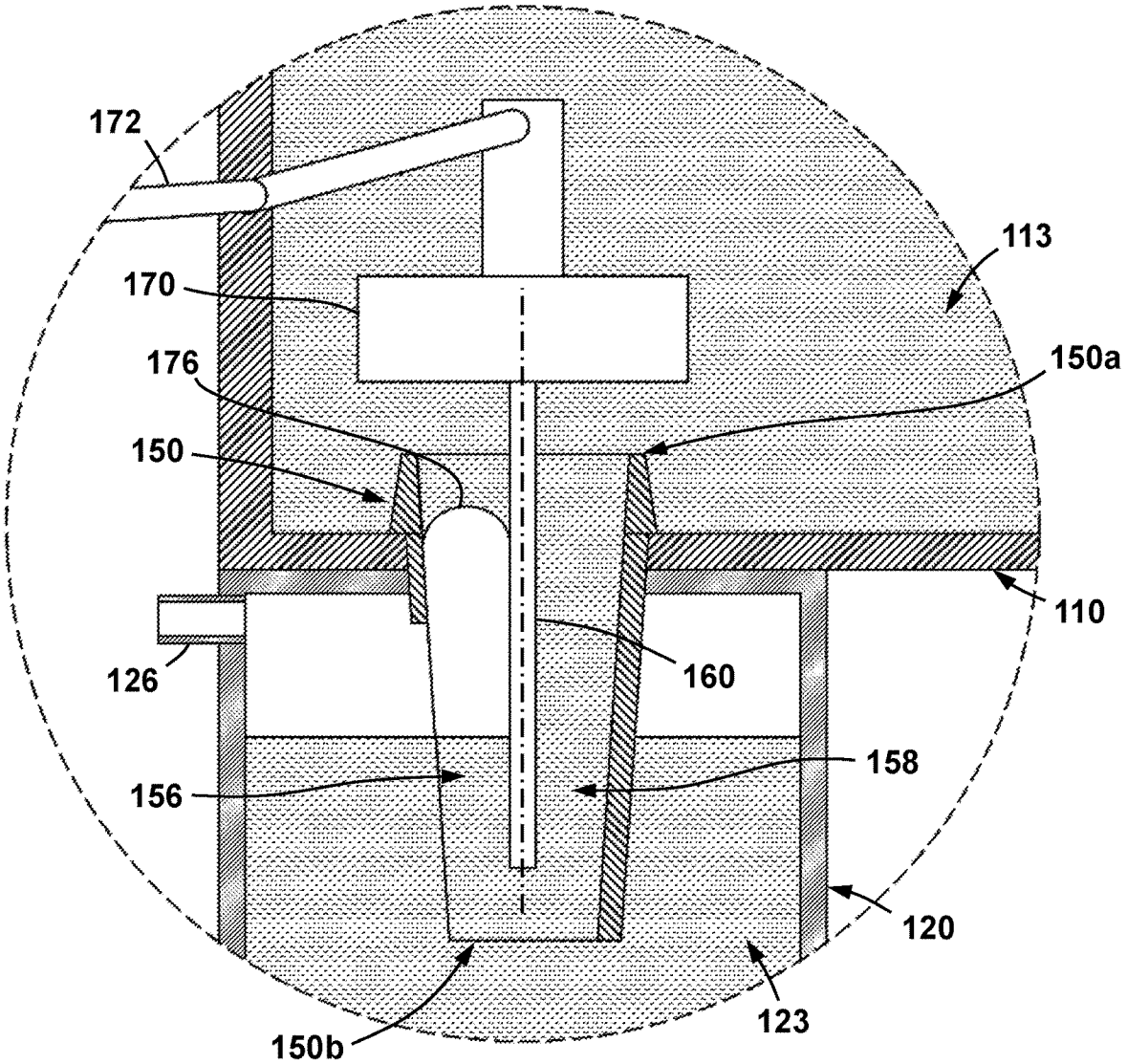
FIGS. 9-11 are progressive enlarged, partial cross-sectional views of the fluid port of the fluid handling system of FIG. 1, with the valve member and barrier of the fluid port being cycled between the open and closed positions to dislodge gas disposed therein.
Figure 10:
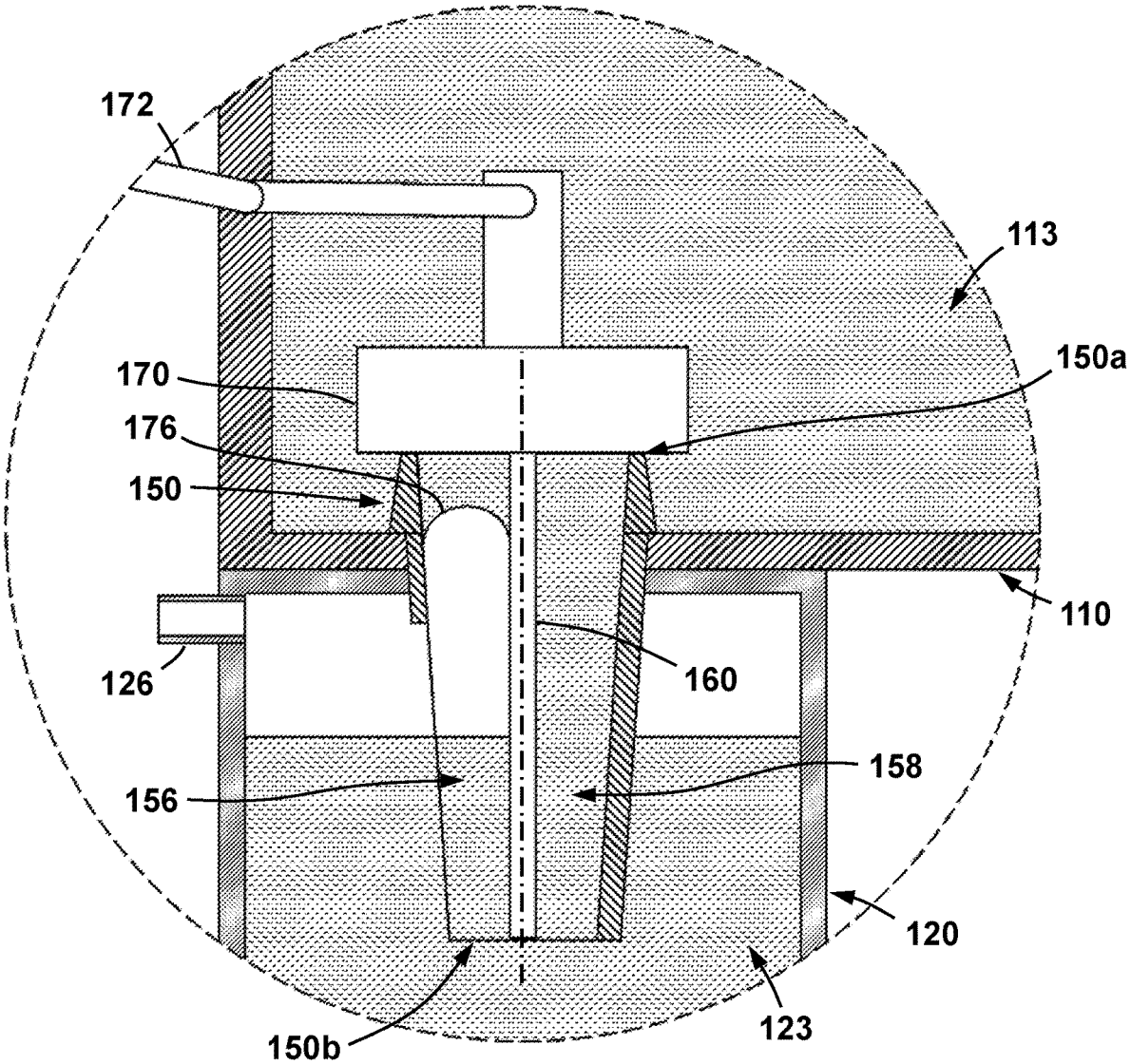
Figure 11:
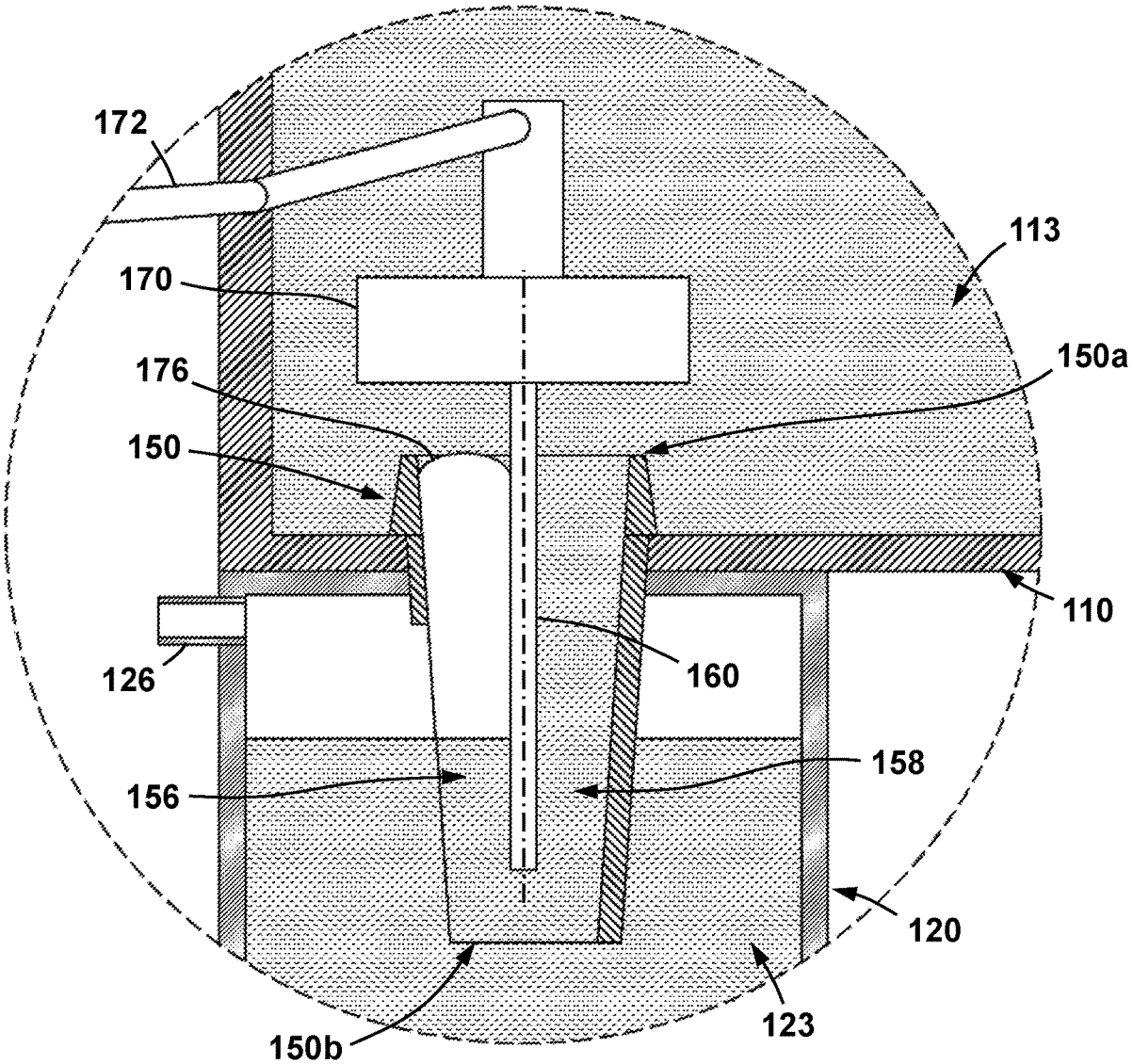

Referring now to FIGS. 9-11, during operations as the liquid printing agent 180 flows through fluid port 150 between chambers 113, 123, air may become lodged within channel 156 and/or channel 158 (see e.g., the meniscus 176 of air disposed within channel 156 in FIG. 9). In some cases, the air (or other gases) lodged within channel 156 may prevent or restrict the continued flow of liquid printing agent 180 through fluid port 150, such that flow through fluid port 150 may be come air-locked. According to some examples disclosed herein, a user may actuate barrier 160 and valve member 170 between the open position and closed position (see e.g., FIGS. 7 and 6, respectively) to encourage the flow of air from channel 156 and/or channel 158.

In particular, as shown in FIG. 9, a meniscus 176 of air is lodged within channel 156 and is blocking further air flow through channel 156 from chamber 123 into chamber 113 so that the flow rate of liquid printing agent 180 through channel 158 from chamber 113 to chamber 123 may be restricted (or ceased entirely). In this example, meniscus 176 is lodged within channel 156 below upper end 150*a* of fluid port 150. Accordingly, as shown in FIG. 10, a user (or a computing device) may actuate lever assembly 172 so that valve member 170 and barrier 160 are actuated from the open position (see FIGS. 9-10) to the closed position (see FIG. 10), and then from the closed position back to the open position (see FIGS. 10-11). The axial movement of barrier 160 within fluid port 150, as valve member 170 and barrier 160 are transitioned or cycled between the open and closed positions as shown in FIGS. 9-11, causes barrier 160 to shear meniscus 176, which thereby encourages upward progress of the air through channel 156 and into chamber 113 of first compartment 110. Thereafter, normal air-liquid exchange through channels 156, 158 of fluid port 150 may resume so that liquid printing agent 180 progresses from chamber 113 to chamber 123 as previously described above.

In some examples, the cycling or movement of valve member 170 and barrier 160 may be altered while still achieving the same shearing function discussed above. For example, in some implementations, valve member 170 and barrier 160 may be further axially translated upward from the open position shown in FIG. 9 (rather than first translating the valve member 170 and barrier 160 to the closed position first as shown in FIGS. 9-10). This additional axially upward movement of valve member 170 and barrier 160 results in the same shearing action discussed above so that meniscus 176 is encouraged to progress upward through channel 156 into chamber 113 in substantially the same manner as previously described.

Referring again to FIGS. 2 and 8, in addition to the axial movement of barrier 160, the tapered inner wall 154 of fluid port 150 may also provide additional flow assurance for air through channel 156 (and/or channel 158) during operations. In particular, because inner wall 154 tapers radially outward from axis 155 when moving axially from lower end 150*b* toward upper end 150*a* of fluid port 150, the cross-sectional area of channels 156, 158 become progressively larger when moving axially from lower end 150*b* toward upper end 150*a* (i.e., when moving from second compartment 120 toward first compartment 110).

Accordingly, for a bubble or meniscus that fills the entire channel 156 and/or channel 158 (e.g., such as meniscus 176 shown in FIG. 9), continued progression of the air axially upward toward upper end 150*a* of fluid port 150 results in progressively more space for the meniscus 176. Without being limited to this or any other theory, this progressively increasing space may also cause a progressive reduction in any distortion (e.g., axial elongation) of the bubble or meniscus so that the overall surface area thereof decreases during axial progression upward toward upper end 150*a*. The reduced fluid pressure associated with decreasing depth of the air may also contribute to the progressively reduced surface area of the bubble or meniscus during axially upward progression as well. The progressive reduction in surface area further reduces contact between the air, inner wall 154, and barrier 160 so that less and less resistance is applied to the air as it continues axially upward flow into chamber 113. As a result, the overall progression of the air (e.g., bubbles, a meniscus, etc.) toward chamber 113 of first compartment 110 is encouraged and facilitated by the shape of fluid port 150 (particularly the tapered inner wall 154).

The examples disclosed herein have provided gas-liquid exchange fluid ports (e.g., fluid port 150) that allow the free counter flow or movement of liquid printing agent and gases (e.g., air). Thus, through use of the fluid ports described herein, the flow reliability of printing agent throughout a printer is enhanced so that printing agent (e.g., liquid printing agent) is reliably flowed through the printer to the printing mechanism (e.g., printing mechanism 12) during printing operations.

While the examples specifically depicted herein include a valve member 170 within chamber 113 of first compartment 110, it should be appreciated that other examples may place valve member 170 (or a similar valve member) within chamber 123 of second compartment 120. During operations, the actuation of valve member 170 within port provides substantially the same functionality discussed above, except that the actuation of valve member 170 occurs within chamber 123 rather than chamber 113.

While various examples have been shown and described, modifications thereof can be made by one skilled in the art without departing from the scope or teachings herein. The examples described herein are not limiting. Many variations and modifications of the systems, apparatus, and processes described herein are possible and are within the scope of the disclosure. Accordingly, the scope of protection is not limited to the examples described herein. The scope of the claims that follow shall include all equivalents of the subject matter of the claims.

What is claimed is:

1. A fluid handling system for a printer, the fluid handling system comprising:

a first compartment;

a second compartment;

a fluid port, wherein the first compartment is fluidly coupled to the second compartment through the fluid port and wherein the first compartment, second compartment and fluid port are disposable within the printer;

a barrier disposed within the fluid port, wherein the barrier separates the fluid port into a first channel and a second channel, wherein the barrier is movable within the fluid port; and a valve member that is movable to selectively engage with a seat disposed about the fluid port within the first compartment, wherein the barrier is coupled to the valve member such that movement of the valve member is to cause the barrier to move within the fluid port.

2. The fluid handling system of claim 1, wherein an inner wall of the fluid port is tapered outward from the second compartment to the first compartment.

3. The fluid handling system of claim 2, wherein the fluid port has a central axis extending from the first compartment to the second compartment, wherein the inner wall extends at an angle θ relative to the central axis that is greater than about 1°.

4. The fluid handling system of claim 3, wherein the angle θ is less than about 10°.

5. The fluid handling system of claim 1, wherein the first compartment is disposed vertically above the second compartment.

6. A fluid handling system for a printer, the fluid handling system comprising:

a first compartment to retain a printing agent;

a second compartment to retain the printing agent, wherein the second compartment is downstream of the first compartment;

a fluid port fluidly coupled between the first compartment and the second compartment, wherein the fluid port includes a central axis;

a barrier disposed within the fluid port, wherein the barrier separates the fluid port into a first channel and a second channel, wherein the barrier is transitionable axially between a first position and a second position within the fluid port with respect to the central axis; and wherein an inner wall of the fluid port tapers radially away from the central axis, from the second compartment to the first compartment.

7. The fluid handling system of claim 6, wherein the inner wall tapers radially away from the central axis at an angle θ relative to the central axis that is greater than about 1°.

8. The fluid handling system of claim 7, wherein the angle θ is less than about 10°.

9. The fluid handling system of claim 6, wherein the first compartment is disposed vertically above the second compartment.

10. The fluid handling system of claim 9, comprising a valve member that is movable to selectively engage with a seat disposed about the fluid port, wherein the barrier is coupled to the valve member such that movement of the valve member is to transition the barrier between the first position and the second position.

11. A printer, comprising:

a printing mechanism to dispense a printing agent onto a substrate;

a first compartment and a second compartment, wherein the first compartment and the second compartment are to receive the printing agent, and wherein the printing mechanism is downstream of the second compartment and the second compartment is downstream of the first compartment;

a fluid port fluidly coupled between the first compartment and the second compartment, wherein the fluid port includes a central axis and an inner wall that tapers radially outward from the central axis, from the second compartment to the first compartment; and a barrier disposed within the fluid port, wherein the barrier separates the fluid port into a first channel and a second channel, wherein the barrier is to be transitioned axially between a first position and a second position within the fluid port with respect to the central axis.

12. The printer of claim 11, comprising a valve member that is movable to selectively engage with a seat disposed about the fluid port within the first compartment to prevent fluid communication between the first compartment and the second compartment through the fluid port, wherein the barrier is coupled to the valve member such that movement of the valve member is to transition the barrier between the first position and the second position.

13. The printer of claim 12, wherein the inner wall of the fluid port is tapered at an angle θ relative to the central axis that is greater than about 1° and less than about 10°.

* * * * *